US008900439B2

(12) United States Patent
Wiedmeyer et al.

(10) Patent No.: US 8,900,439 B2
(45) **Date of Patent: *Dec. 2, 2014**

(54) MODULAR CATHODE ASSEMBLIES AND METHODS OF USING THE SAME FOR ELECTROCHEMICAL REDUCTION

(75) Inventors: Stanley G. Wiedmeyer, Glen Ellyn, IL (US); Laurel A. Barnes, Chicago, IL (US); Mark A. Williamson, Naperville, IL (US); James L. Willit, Batavia, IL (US)

(73) Assignee: GE-Hitachi Nuclear Energy Americas LLC, Wilmington, NC (US)

( * ) Notice: Subject to any disclaimer, the term of this patent is extended or adjusted under 35 U.S.C. 154(b) by 317 days.

This patent is subject to a terminal disclaimer.

(21) Appl. No.: 12/978,005

(22) Filed: Dec. 23, 2010

(65) Prior Publication Data

US 2012/0160700 A1 Jun. 28, 2012

(51) Int. Cl.

| | |
|---|---|
| ***C25C 7/02*** | (2006.01) |
| ***C25C 3/34*** | (2006.01) |
| ***C25C 7/00*** | (2006.01) |
| ***G21F 9/30*** | (2006.01) |

(52) U.S. Cl.

CPC . *C25C 3/34* (2013.01); *C25C 7/005* (2013.01); *C25C 7/025* (2013.01); *G21F 9/30* (2013.01)

USPC ..... 205/560

(58) Field of Classification Search

USPC ..... 205/560

See application file for complete search history.

(56) References Cited

U.S. PATENT DOCUMENTS

| | | | |
|---|---|---|---|
| 422,139 | A | 2/1890 | Maxon |
| 2,089,738 | A | 8/1935 | Elmer |
| 2,194,444 | A | 3/1940 | Hulse et al. |

(Continued)

FOREIGN PATENT DOCUMENTS

| | | |
|---|---|---|
| AU | 622994 | 4/1992 |
| CA | 1 142 123 | 3/1983 |

(Continued)

OTHER PUBLICATIONS

Jeong, et al., "Electrolytic production of metallic Uranium from $U_3O_8$ in a 20-kg batch scale reactor", Journal of Radioanalytical and Nuclear Chemistry, vol. 268, No. 2, pp. 349-356 (2006).

(Continued)

*Primary Examiner* — James Lin
*Assistant Examiner* — Ho-Sung Chung
(74) *Attorney, Agent, or Firm* — Harness, Dickey & Pierce, P.L.C.

(57) ABSTRACT

Modular cathode assemblies are useable in electrolytic reduction systems and include a basket through which fluid electrolyte may pass and exchange charge with a material to be reduced in the basket. The basket can be divided into upper and lower sections to provide entry for the material. Example embodiment cathode assemblies may have any shape to permit modular placement at any position in reduction systems. Modular cathode assemblies include a cathode plate in the basket, to which unique and opposite electrical power may be supplied. Example embodiment modular cathode assemblies may have standardized electrical connectors. Modular cathode assemblies may be supported by a top plate of an electrolytic reduction system. Electrolytic oxide reduction systems are operated by positioning modular cathode and anode assemblies at desired positions, placing a material in the basket, and charging the modular assemblies to reduce the metal oxide.

9 Claims, 5 Drawing Sheets

(56) References Cited

U.S. PATENT DOCUMENTS

| | | | | |
|---|---|---|---|---|
| 2,800,219 | A | 7/1957 | Carroll | |
| 2,913,380 | A * | 11/1959 | Gullett | 205/366 |
| 3,562,131 | A | 2/1971 | Jasberg | |
| 3,645,708 | A | 2/1972 | Grady | |
| 3,697,404 | A | 10/1972 | Paige | |
| 3,972,794 | A | 8/1976 | Lamm | |
| 4,013,329 | A | 3/1977 | Hugin | |
| 4,023,673 | A | 5/1977 | Hansen | |
| 4,039,403 | A * | 8/1977 | Astley et al. | 205/573 |
| 4,073,703 | A | 2/1978 | Kinosz | |
| 4,148,392 | A | 4/1979 | Larson et al. | |
| 4,203,531 | A | 5/1980 | Reichel et al. | |
| 4,326,937 | A | 4/1982 | Neumeier et al. | |
| 4,437,968 | A | 3/1984 | Elliott, Jr. | |
| 4,492,621 | A | 1/1985 | Stubb | |
| 4,668,353 | A * | 5/1987 | Smith et al. | 205/628 |
| 4,851,098 | A | 7/1989 | Kimura et al. | |
| 4,863,580 | A | 9/1989 | Epner | |
| 4,880,506 | A | 11/1989 | Ackerman et al. | |
| 4,946,026 | A | 8/1990 | Rickman | |
| 5,015,342 | A | 5/1991 | Ginatta et al. | |
| 5,415,742 | A | 5/1995 | La Camera et al. | |
| 5,454,914 | A | 10/1995 | Gay | |
| 5,531,868 | A | 7/1996 | Miller et al. | |
| 5,582,706 | A | 12/1996 | Grantham et al. | |
| 5,689,538 | A | 11/1997 | Bonhomme | |
| 5,770,034 | A | 6/1998 | Jansen et al. | |
| 5,855,749 | A | 1/1999 | Kohut et al. | |
| 5,935,394 | A | 8/1999 | Sivilotti et al. | |
| 6,142,291 | A | 11/2000 | Schulze et al. | |
| 6,540,902 | B1 | 4/2003 | Redey et al. | |
| 6,689,260 | B1 | 2/2004 | Ahluwalia et al. | |
| 6,821,405 | B1 | 11/2004 | Marttila | |
| 6,866,768 | B2 | 3/2005 | Bradford et al. | |
| 7,011,736 | B1 * | 3/2006 | Miller et al. | 205/47 |
| 7,090,760 | B2 | 8/2006 | Seo et al. | |
| 7,097,747 | B1 * | 8/2006 | Herceg et al. | 204/201 |
| 7,449,635 | B2 | 11/2008 | Wiant | |
| 7,563,982 | B2 | 7/2009 | Kimmel | |
| 7,638,026 | B1 | 12/2009 | Willit et al. | |
| 7,799,185 | B1 | 9/2010 | Willit | |
| 8,248,760 | B2 | 8/2012 | Abrahamsen et al. | |
| 2004/0007466 | A1 | 1/2004 | Seo et al. | |
| 2004/0134785 | A1 | 7/2004 | Gay et al. | |
| 2004/0168932 | A1 * | 9/2004 | Wang | 205/560 |
| 2005/0067291 | A1 | 3/2005 | Haiki et al. | |
| 2005/0205428 | A1 | 9/2005 | Dees et al. | |
| 2005/0233634 | A1 | 10/2005 | Kollmann | |
| 2006/0067291 | A1 | 3/2006 | Nakata | |
| 2006/0096853 | A1 | 5/2006 | King | |
| 2007/0082551 | A1 | 4/2007 | Oesterhaus | |
| 2007/0295601 | A1 | 12/2007 | Bayer | |
| 2008/0128270 | A1 | 6/2008 | Hiraiwa et al. | |
| 2008/0142374 | A1 | 6/2008 | Iwama et al. | |
| 2008/0152270 | A1 | 6/2008 | Engesser et al. | |
| 2009/0050483 | A1 | 2/2009 | Li | |
| 2009/0152124 | A1 * | 6/2009 | Ashford et al. | 205/574 |
| 2010/0276259 | A1 | 11/2010 | Phalen | |
| 2011/0100328 | A1 | 5/2011 | Paul | |
| 2011/0180409 | A1 | 7/2011 | Willit et al. | |

FOREIGN PATENT DOCUMENTS

| | | |
|---|---|---|
| DE | 26 00 344 | 7/1977 |
| DE | 3837572 | 5/1989 |
| DE | 19345258 | 3/2000 |
| DE | 19845258 C1 | 3/2000 |
| EP | 0 286 092 | 10/1988 |
| EP | 0 736 929 | 10/1996 |
| EP | 2224542 | 9/2010 |
| GB | 284678 | 11/1928 |
| GB | 506590 | 5/1939 |
| GB | 516775 | 1/1940 |
| JP | H05279887 | 10/1993 |
| JP | H0972991 | 3/1997 |
| JP | 2006-308442 | 11/2006 |
| WO | WO 02/066709 | 8/2002 |
| WO | WO 2004/018737 | 3/2004 |
| WO | WO 2004/031453 | 4/2004 |
| WO | WO 2005/035404 | 4/2005 |
| WO | WO 2006/007863 | 1/2006 |
| WO | WO 2009/062005 | 5/2009 |
| WO | WO 2010/080761 | 7/2010 |

OTHER PUBLICATIONS

International Search Report dated Jan. 20, 2012 issued in PCT/US2011/053589.

International Search Report dated Jan. 30, 2012 issued in PCT/US2011/053878.

International Search Report dated Feb. 6, 2012 issued in PCT/US2011/053872.

International Search Report dated May 11, 2012 issued in PCT/US2011/053871.

Steven D. Herrman, et al., "Electrolytic Reduction of Spent Oxide Fuel—Bench-Scale Test Results", Global 2005, INL/CON-05-00304, Paper No. 488, Oct. 2005.

"Proceedings of GLOBAL 2005", Tsukuba, Japan, Oct. 9-13, 2005, Paper No. 488.

International Search Report and Written Opinion issued in International Patent Application No. PCT/US2012/058664, mailed Jul. 8, 2013.

International Search Report and Written Opinion issued in International Patent Application No. PCT/US2012/058659, mailed Jul. 5, 2013.

International Search Report and Written Opinion issued in International Patent Application No. PCT/US2012/058661, mailed Jul. 25, 2013.

Figueroa, J. et al., "GTRI Progress in Developing Pyrochemical Processes for Recovery of Fabrication Scrap and Reprocessing of Monolithic U-MO Fuel", RERTR 2011—International Meeting on Reduced Enrichment for Research and Test Reactors, Oct. 23, 2011, XP055071122.

International Search Report and Written Opinion issued in International Patent Application No. PCT/US2012/058663, issued Aug. 12, 2013.

International Search Report and Written Opinion issued in International Patent Application No. PCT/US2012/058531, issued Aug. 2, 2013.

European Search Report issued in European Patent Application No. 13163951.0, issued Aug. 29, 2013.

Journeau, et al., "Physico-chemical analyses and solidification path reconstruction of multi-component oxidic spread melts." Materials Science and Engineering A. vol. 299. Feb. 15, 2001, pp. 249-266.

International Atomic Energy Agency (IAEA). "Storage and Disposal of Spent Fuel and High Level Radioactive Waste". Additional paper to the IAEA's Nuclear Technology Review (2006), pp. 1-11.

Morss, et al., "Cerium, uranium, and plutonium behavior in glass-bonded sodalite, a ceramic nuclear waste form." Journal of Alloys and Compounds. vols. 303-304. May 24, 2000. pp. 42-48.

Abraham, et al., "Metal waste forms from treatment of EBR-11 spent fuel." Argonne National Laboratory. Presented at Spectrum '98 Conference. Sep. 18, 1998, pp. 1-7.

* cited by examiner

MODULAR CATHODE ASSEMBLIES AND METHODS OF USING THE SAME FOR ELECTROCHEMICAL REDUCTION

GOVERNMENT SUPPORT

This invention was made with Government support under contract number DE-AC02-06CH11357, awarded by the U.S. Department of Energy. The Government has certain rights in the invention.

BACKGROUND

Single and multiple-step electrochemical processes are useable to reduce metal-oxides to their corresponding metallic (unoxidized) state. Such processes are conventionally used to recover high purity metal, metals from an impure feed, and/or extract metals from their metal-oxide ores.

Multiple-step processes conventionally dissolve metal or ore into an electrolyte followed by an electrolytic decomposition or selective electro-transport step to recover unoxidized metal. For example, in the extraction of uranium from spent nuclear oxide fuels, a chemical reduction of the uranium oxide is performed at 650° C., using a reductant such as Li dissolved in molten LiCl, so as to produce uranium and $Li_2O$. The solution is then subjected to electro-winning, where dissolved $Li_2O$ in the molten LiCl is electrolytically decomposed to regenerate Li. The uranium metal is prepared for further use, such as nuclear fuel in commercial nuclear reactors.

Single-step processes generally immerse a metal oxide in molten electrolyte, chosen to be compatible with the metal oxide, together with a cathode and anode. The cathode electrically contacts the metal oxide and, by charging the anode and cathode (and the metal oxide via the cathode), the metal oxide is reduced through electrolytic conversion and ion exchange through the molten electrolyte.

Single-step processes generally use fewer components and/or steps in handling and transfer of molten salts and metals, limit amounts of free-floating or excess reductant metal, have improved process control, and are compatible with a variety of metal oxides in various starting states/mixtures with higher-purity results compared to multi-step processes.

SUMMARY

Example embodiments include modular cathode assemblies useable in electrolytic reduction systems. Example embodiment cathode assemblies include a basket that allows a fluid electrolyte to enter and exit the basket, while the basket is electrically conductive and may transfer electrons to or from an electrolyte in the basket. The basket extends down into an electrolyte from an assembly support having a basket electrical connector to provide electric power to the basket. The basket may be divided into an upper and lower section so as to provide a space where the material to be reduced may be inserted into the lower section and so as to prevent electrolyte or other material or thermal migration up the basket. Example embodiment cathode assemblies are disclosed with a rectangular shape that maximizes electrolyte surface area for reduction, while also permitting easy and modular placement of the assemblies at a variety of positions in reduction systems. Example embodiment modular cathode assemblies also include a cathode plate running down the middle of the basket. The cathode plate is electrically insulated from the basket but is also electrically conductive and provides a primary or reducing current to the material to be reduced in the basket. Thermal and electrical insulating bands or pads may also be placed along a length of the cathode plate to align and seal the basket upper portion with the cathode plate. Example embodiment modular cathode assemblies may have one or more standardized electrical connectors through which unique electrical power may be provided to the basket and plate. For example, the electrical connectors may have a same knife-edge shape that can electrically and mechanically connect modular cathode assemblies at several positions of electrical contacts having corresponding shapes.

Example embodiment modular cathode assemblies are useable in electrolytic oxide reduction systems where they may be placed at a variety of desired positions. Example embodiment modular cathode assembly may be supported by a top plate above an opening into the electrolyte container. Electrolytic oxide reduction systems may provide a series of standardized electrical contacts that may provide power to both baskets and cathode plates at several desired positions in the system. Example methods include operating an electrolytic oxide reduction system by positioning modular cathode and anode assemblies at desired positions, placing a material to be reduced in the basket, and charging the modular cathode and anode assemblies through the electrical connectors so as to reduce the metal oxide and free oxygen gas. The electrolyte may be fluidized in example methods so that the anodes, basket, and material to be reduced in the basket extend into the electrolyte. Additionally, unique levels and polarities of electrical power may be supplied to each of the modular cathode assembly baskets and cathode plates and modular anode assembly, in order to achieve a desired operational characteristic, such as reduction speed, material volume, off-gas rate, oxidizing or reducing potential, etc.

DETAILED DESCRIPTION

Figure 1:
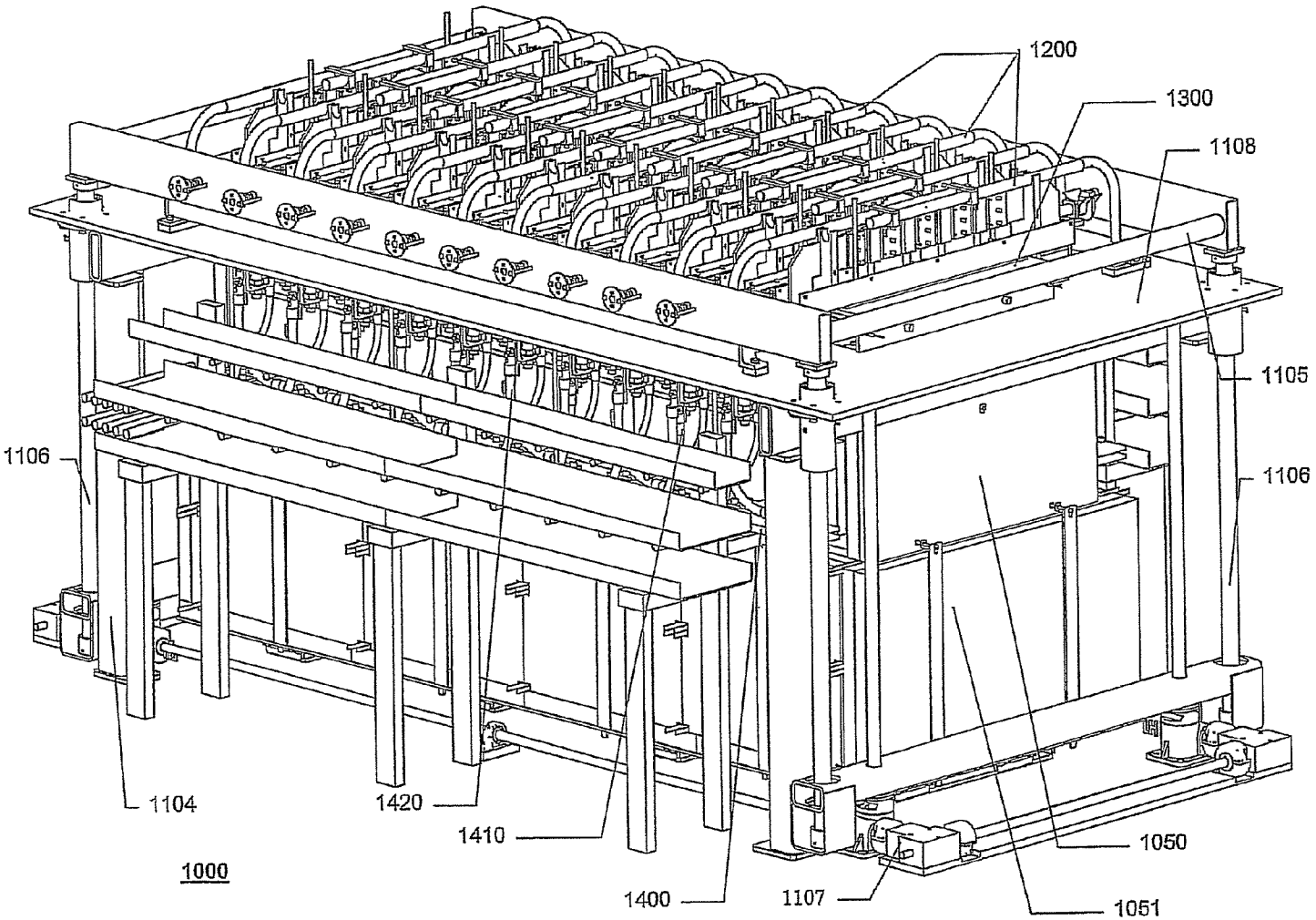
FIG. 1 is an illustration of an example embodiment electrolytic oxide reduction system.

Hereinafter, example embodiments will be described in detail with reference to the attached drawings. However, specific structural and functional details disclosed herein are merely representative for purposes of describing example embodiments. The example embodiments may be embodied in many alternate forms and should not be construed as limited to only example embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments. As used herein, the term "and/or" includes any and all combinations of one or more of the associated listed items.

It will be understood that when an element is referred to as being "connected," "coupled," "mated," "attached," or "fixed" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between", "adjacent" versus "directly adjacent", etc.).

As used herein, the singular forms "a", "an" and "the" are intended to include the plural forms as well, unless the language explicitly indicates otherwise. It will be further understood that the terms "comprises", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures or described in the specification. For example, two figures or steps shown in succession may in fact be executed in series and concurrently or may sometimes be executed in the reverse order or repetitively, depending upon the functionality/acts involved.

The inventors have recognized a problem in existing single-step electrolytic reduction processes that the known processes cannot generate large amounts of reduced, metallic products on a commercial or flexible scale, at least in part because of limited, static cathode size and configuration. Single step electrolytic reduction processes may further lack flexibility in configuration, such as part regularity and replaceability, and in operating parameters, such as power level, operating temperature, working electrolyte, etc. Example systems and methods described below uniquely address these and other problems, discussed below or not.

Example Embodiment Electrolytic Oxide Reduction Systems

FIG. 1 is an illustration of an example embodiment electrolytic oxide reduction system (EORS) 1000. Although aspects of example embodiment EORS 1000 are described below and useable with related example embodiment components, EORS 1000 is further described in the following co-pending applications:

| Serial No. | Filing Date | Attorney Docket No. |
|---|---|---|
| XX/XXX,XXX | Herewith | 24AR246135 (8564-000224) |
| XX/XXX,XXX | Herewith | 24AR246136 (8564-000225) |
| XX/XXX,XXX | Herewith | 24AR246138 (8564-000226) |
| XX/XXX,XXX | Herewith | 24AR246140 (8564-000228) |

The disclosures of the above-listed co-pending applications are incorporated by reference herein in their entirety.

As shown in FIG. 1, example embodiment EORS 1000 includes several modular components that permit electrolytic reduction of several different types of metal-oxides on a flexible or commercial scale basis. Example embodiment EORS 1000 includes an electrolyte container 1050 in contact with or otherwise heated by a heater 1051, if required to melt and/or dissolve an electrolyte in container 1050. Electrolyte container 1050 is filled with an appropriate electrolyte, such as a halide salt or salt containing a soluble oxide that provides mobile oxide ions, chosen based on the type of material to be reduced. For example, $CaCl_2$ and CaO, or $CaF_2$ and CaO, or some other Ca-based electrolyte, or a lithium-based electrolyte mixture such as LiCl and $Li_2O$, may be used in reducing rare-earth oxides, or actinide oxides such as uranium or plutonium oxides, or complex oxides such as spent nuclear fuel. The electrolyte may further be chosen based on its melting point. For example, an electrolyte salt mixture of LiCl and $Li_2O$ may become molten at around 610° C. at standard pressure, whereas a $CaCl_2$ and CaO mixture may require an operating temperature of approximately 850° C. Concentrations of the dissolved oxide species may be controlled during reduction by additions of soluble oxides or chlorides by electrochemical or other means.

EORS 1000 may include several supporting and structural members to contain, frame, and otherwise support and structure other components. For example, one or more lateral supports 1104 may extend up to and support a top plate 1108, which may include an opening (not shown) above electrolyte container 1050 so as to permit access to the same. Top plate 1108 may be further supported and/or isolated by a glove box (not shown) connecting to and around top plate 1108. Several standardized electrical contacts 1480 (FIG. 2) and cooling sources/gas exhausts may be provided on or near top plate 1108 to permit anode and cathode components to be supported by and operable through EORS 1000 at modular positions. A lift basket system, including a lift bar 1105 and/or guide rods 1106 may connect to and/or suspend cathode assemblies 1300 that extend down into the molten electrolyte in electrolyte container 1050. Such a lift basket system may permit selective lifting or other manipulation of cathode assemblies 1300 without moving the remainder of EORS 1000 and related components.

In FIG. 1, EORS 1000 is shown with several cathode assemblies 1300 alternating with several anode assemblies 1200 supported by various support elements and extending into electrolyte container 1050. The assemblies may further be powered or cooled through standardized connections to corresponding sources in EORS 1000. Although ten cathode assemblies 1300 and eleven anode assemblies 1200 are shown in FIG. 1, any number of anode assemblies 1200 and cathode assemblies 1300 may be used in EORS 1000, depending on energy resources, amount of material to be reduced, desired amount of metal to be produced, etc. That is, individual cathode assemblies 1300 and/or anode assemblies 1200 may be added or removed so as to provide a flexible, and potentially large, commercial-scale, electrolytic reduction system. In this way, through the modular design of example embodiment EORS 1000, anode assemblies 1200 and cathode assemblies 1300, example embodiments may better satisfy material production requirements and energy consumption limits in a fast, simplified single-stage reduction operation. The modular design may further enable quick repair and standardized fabrication of example embodiments, lower manufacturing and refurbishing costs and time consumption.

Figure 2:
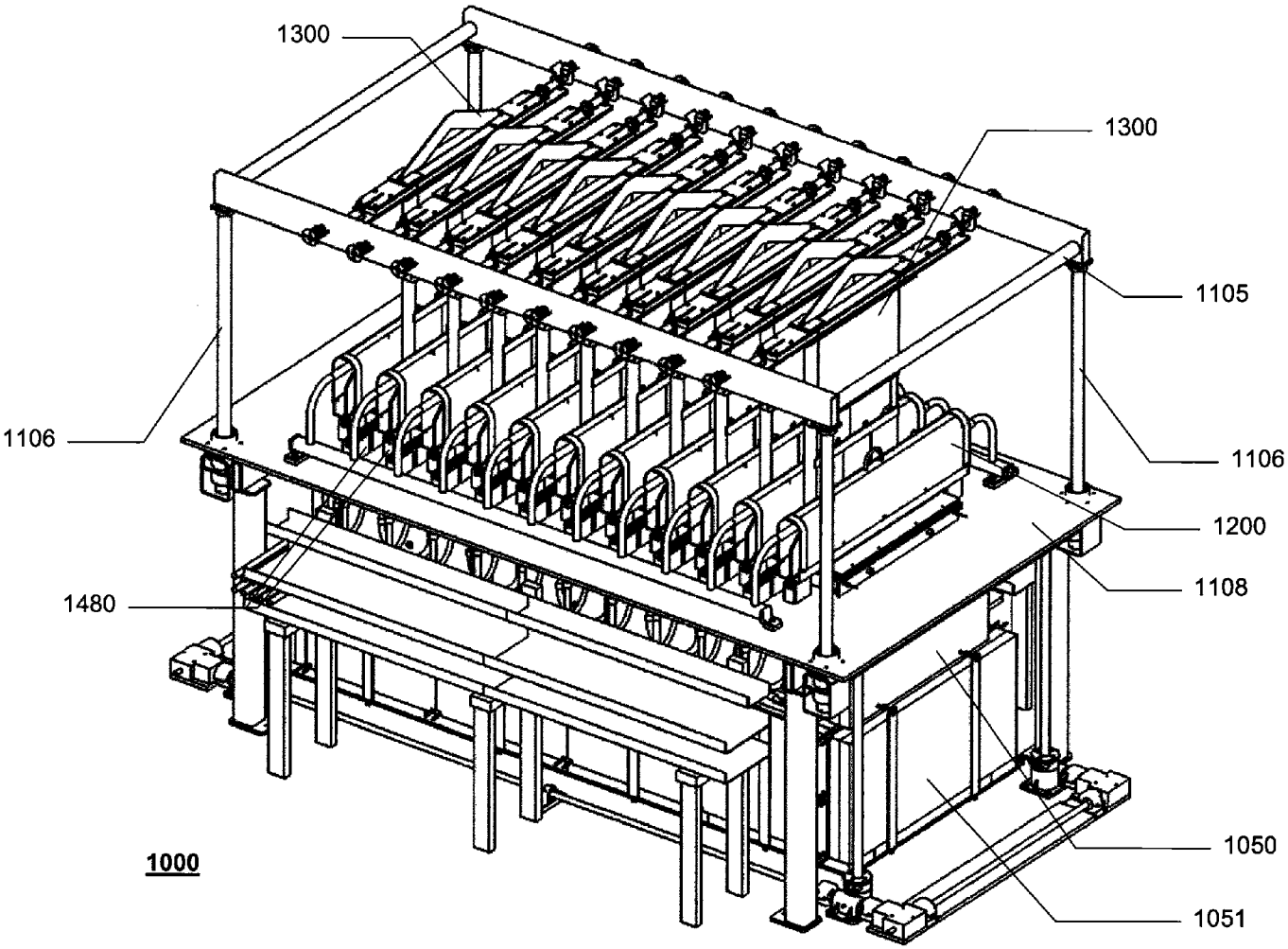
FIG. 2 is another illustration of the example embodiment electrolytic oxide reduction system of FIG. 1 in an alternate configuration.

FIG. 2 is an illustration of EORS 1000 in an alternate configuration, with basket lifting system including lift bar 1105 and guide rods 1106 raised so as to selectively lift only modular cathode assemblies 1300 out of electrolyte container 1050 for access, permitting loading or unloading of reactant metals oxides or produced reduced metals from cathode assemblies 1300. In the configuration of FIG. 2, several modular electrical contacts 1480 are shown aligned at modular positions about the opening in top plate 1108. For example, electrical contacts 1480 may be knife-edge contacts that permit several different alignments and positions of modular cathode assemblies 1300 and/or anode assemblies 1200 within EORS 1000.

As shown in FIG. 1, a power delivery system including a bus bar 1400, anode power cable 1410, and/or cathode power cable 1420 may provide independent electric charge to anode assemblies 1200 and/or cathode assemblies 1300, through electrical contacts (not shown). During operation, electrolyte in electrolyte container 1050 may be liquefied by heating and/or dissolving or otherwise providing a liquid electrolyte material compatible with the oxide to be reduced. Operational temperatures of the liquefied electrolyte material may range from approximately 400-1200° C., based on the materials used. Oxide material, including, for example, $Nd_2O_3$, $PuO_2$, $UO_2$, complex oxides such as spent oxide nuclear fuel or rare earth ores, etc., is loaded into cathode assemblies 1300, which extend into the liquid electrolyte, such that the oxide material is in contact with the electrolyte and cathode assembly 1300.

The cathode assembly 1300 and anode assembly 1200 are connected to power sources so as to provide opposite charges or polarities, and a current-controlled electrochemical process occurs such that a desired electrochemically-generated reducing potential is established at the cathode by reductant electrons flowing into the metal oxide at the cathode. Because of the generated reducing potential, oxygen in the oxide material within the cathode assemblies 1300 is released and dissolves into the liquid electrolyte as an oxide ion. The reduced metal in the oxide material remains in the cathode assembly 1300. The electrolytic reaction at the cathode assemblies may be represented by equation (1):

$$\text{(Metal Oxide)}+2e^{-}\rightarrow\text{(reduced Metal)}+O^{2-} \quad (1)$$

where the $2e^{-}$ is the current supplied by the cathode assembly 1300.

At the anode assembly 1200, negative oxygen ions dissolved in the electrolyte may transfer their negative charge to the anode assembly 1200 and convert to oxygen gas. The electrolysis reaction at the anode assemblies may be represented by equation (2):

$$2O^{2-}\rightarrow O_2+4e^{-} \quad (2)$$

where the $4e^{-}$ is the current passing into the anode assembly 1200.

If, for example, a molten Li-based salt is used as the electrolyte, cathode reactions above may be restated by equation (3):

$$\text{(Metal Oxide)}+2e^{-}+2Li^{+}\rightarrow\text{(Metal Oxide)}+2Li\rightarrow\text{(reduced Metal)}+2Li++O^{2-} \quad (3)$$

However, this specific reaction sequence may not occur, and intermediate electrode reactions are possible, such as if cathode assembly 1300 is maintained at a less negative potential than the one at which lithium deposition will occur. Potential intermediate electrode reactions include those represented by equations (4) and (5):

$$\text{(Metal Oxide)}+xe^{-}+2Li^{+}\rightarrow Li_x\text{(Metal Oxide)} \quad (4)$$

$$Li_x\text{(Metal Oxide)}+(2-x)e^{-}+(2-x)Li^{+}\rightarrow\text{(reduced Metal)}+2Li^{+}+O^{2-} \quad (5)$$

Incorporation of lithium into the metal oxide crystal structure in the intermediate reactions shown in (4) and (5) may improve conductivity of the metal oxide, favoring reduction.

Reference electrodes and other chemical and electrical monitors may be used to control the electrode potentials and rate of reduction, and thus risk of anode or cathode damage/corrosion/overheating/etc. For example, reference electrodes may be placed near a cathode surface to monitor electrode potential and adjust voltage to anode assemblies 1200 and cathode assemblies 1300. Providing a steady potential sufficient only for reduction may avoid anode reactions such as chlorine evolution and cathode reactions such as free-floating droplets of electrolyte metal such as lithium or calcium.

Efficient transport of dissolved oxide-ion species in a liquid electrolyte, e.g. $Li_2O$ in molten LiCl used as an electrolyte, may improve reduction rate and unoxidized metal production in example embodiment EORS 1000. Alternating anode assemblies 1200 and cathode assemblies 1300 may improve dissolved oxide-ion saturation and evenness throughout the electrolyte, while increasing anode and cathode surface area for larger-scale production. Example embodiment EORS 1000 may further include a stirrer, mixer, vibrator, or the like to enhance diffusional transport of the dissolved oxide-ion species.

Chemical and/or electrical monitoring may indicate that the above-described reducing process has run to completion, such as when a voltage potential between anode assemblies 1200 and cathode assemblies 1300 increases or an amount of dissolved oxide ion decreases. Upon a desired degree of completion, the reduced metal created in the above-discussed reducing process may be harvested from cathode assemblies 1300, by lifting cathode assemblies 1300 containing the retained, reduced metal out of the electrolyte in container 1050. Oxygen gas collected at the anode assemblies 1200 during the process may be periodically or continually swept away by the assemblies and discharged or collected for further use.

Although the structure and operation of example embodiment EORS 1000 has been shown and described above, it is understood that several different components described in the incorporated documents and elsewhere are useable with example embodiments and may describe, in further detail, specific operations and features of EORS 1000. Similarly, components and functionality of example embodiment EORS 1000 is not limited to the specific details given above or in the incorporated documents, but may be varied according to the needs and limitations of those skilled in the art.

Example Embodiment Cathode Assemblies

Figure 3:
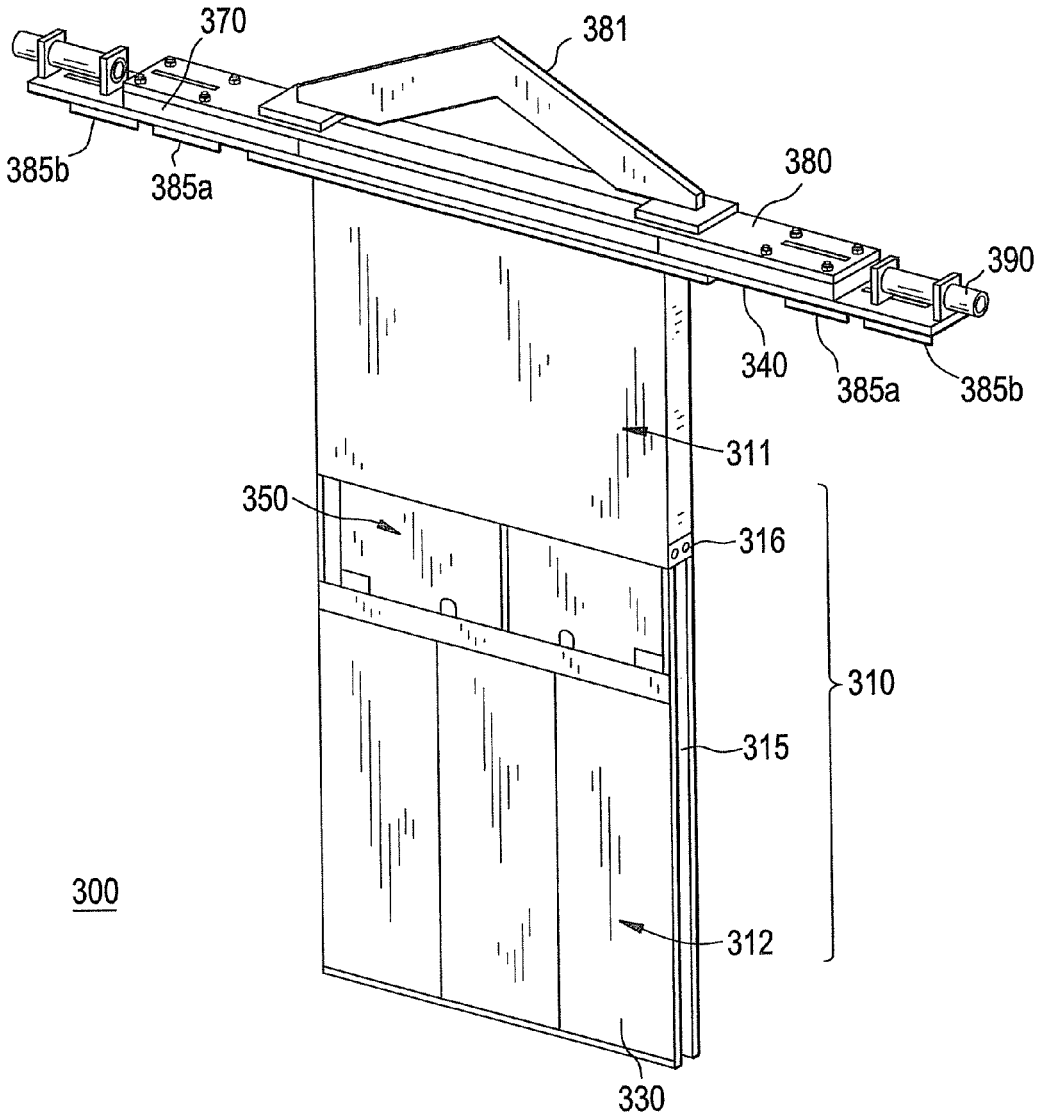
FIG. 3 is an illustration of an example embodiment modular cathode assembly.
Figure 4:
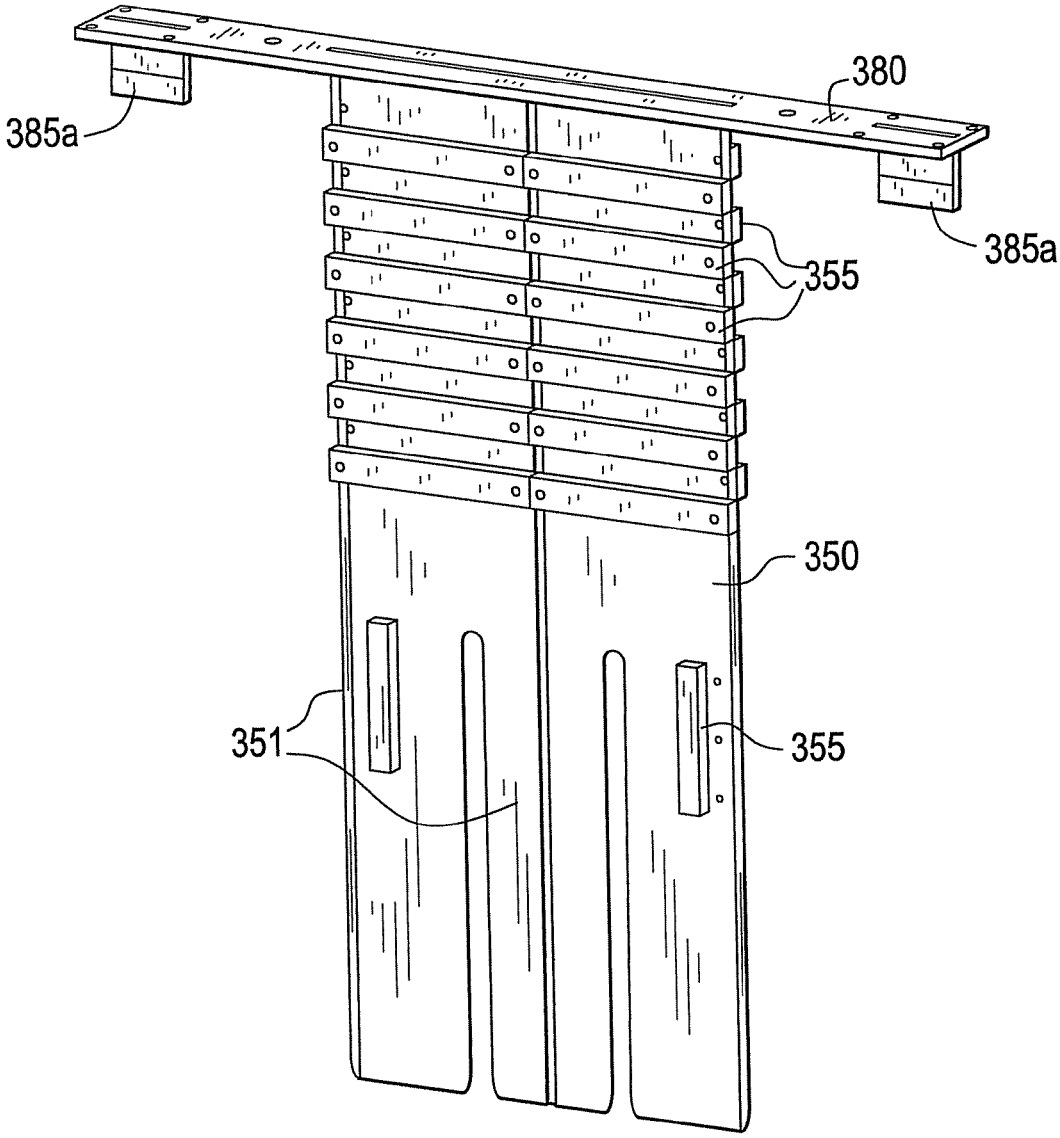
FIG. 4 is an illustration of a cathode plate useable in example embodiment modular cathode assemblies.

FIG. 3 is an illustration of an example embodiment modular cathode assembly 300. Modular cathode assembly 300 may be useable as cathode assemblies 1300 described above in connection with FIG. 1. Although example embodiment assembly 300 is illustrated with components from and useable with EORS 1000 (FIGS. 1-2), it is understood that example embodiments are useable in other electrolytic reduction systems. Similarly, while one example assembly 300 is shown in FIGS. 3 & 4, it is understood that multiple example assemblies 300 are useable with electrolytic reduction devices. In EORS 1000 (FIGS. 1-2), for example, multiple cathode assemblies may be used in a single EORS 1000 to provide balanced modular anode and/or cathode assemblies.

As shown in FIG. 3, example embodiment modular cathode assembly 300 includes a basket 310, into which oxides or other materials for reduction may be placed. Basket 310 may include an upper portion 311 and a lower portion 312, and these portions may have differing structures to accommodate use in reduction systems. For example, lower portion 312 may be structured to interact with/enter into a liquid electrolyte, such as those molten salt electrolytes discussed above. Lower portion 312 may be vertically displaced from upper portion 311 to ensure immersion in/extension into any electrolyte, while upper portion 311 may reside above an electrolyte level.

Lower portion 312 may form a basket or other enclosure that holds or otherwise retains the material to be reduced. As shown in FIG. 3, lower portion 312 may be divided into three or more sections to separate and/or evenly distribute material to be reduced in lower portion 312. The separation in lower portion 312 may also provide additional surface area for direct contact and electrical flow between target material and basket 310 during a reducing operation. Lower portion 312 and upper portion 311 may be sufficiently divided to define a gap or other opening through which material may be placed into lower portion 312. For example, as shown in FIG. 3, upper portion 311 and lower portion 312 may be joined at a rivet point 316 along shared sheet metal side 315 so as to define a gap for oxide entry along a planar face of example embodiment modular cathode assembly 300. While upper portion 311 and lower portion 312 may include some discontinuity, it is understood that electrical current may still flow through both portions, and the two portions are flexibly mechanically connected, through rivet point 316 or any other suitable electromechanical connection.

Permeable material 330 is placed along planar faces of lower portion 312 in the example embodiment of FIG. 3. The permeable material 330 permits liquid electrolyte to pass into lower portion 312 while retaining a material to be reduced, such as uranium oxide, so that the material does not physically disperse into the electrolyte or outside basket 310. Permeable material 330 may include any number of materials that are resilient to, and allow passage of, ionized electrolyte therethrough, including inert membranes and finely porous metallic plates, for example. The permeable material 330 may be joined to a sheet metal edge 315 and bottom to form an enclosure that does not permit oxide or reduced metal to escape from the lower portion 312. In this way, lower portion 312 may provide space for holding several kilograms of material for reduction, permitting reduction on a flexible and commercial scale, while reducing areas where molten electrolyte may solidify or clog.

Upper portion 311 may be hollow and enclosed, or any other desired shape and length to permit use in reduction systems. Upper portion 311 joins to an assembly support 340, such that upper portion 311 and lower portion 312 of basket 310 extend from and are supported by assembly support 340. Assembly support 340 may support example embodiment modular cathode assembly 300 above an electrolyte. For example, assembly support 340 may extend to overlap top plate 1108 in EORS 1000 so as to support modular cathode assembly extending into electrolyte container 1050 from above. Although lower portion 312 may extend into ionized, high-temperature electrolyte, the separation from upper portion 311 may reduce heat and/or caustic material transfer to upper portion 311 and the remaining portions of modular cathode assembly 300, reducing damage and wear. Although basket 310 is shown with a planar shape extending along assembly support 340 to provide a large surface area for permeable material 330 and electrolyte interaction therethrough, basket 310 may be shaped, positioned, and sized in any manner based on desired functionality and contents.

As shown in FIGS. 3 and 4, example embodiment modular cathode assembly 300 further includes a cathode plate 350. Cathode plate 350 may extend through and/or be supported by assembly support 340 and extend into basket 310. Cathode plate 350 may extend a substantial distance into basket 310, into lower section 312 so as to be submerged in electrolyte with lower section 312 and directly contact oxide material to be reduced that is held in lower section 312. As shown in FIG. 4, cathode plate may include a shape or structure to compatibly fit or match with basket 310, dividing into three sections at a lower portion to match the three individual lower baskets of lower section 312, as an example.

Cathode plate 350 is electrically insulated from basket 310, except for indirect current flow from/into cathode plate 350 into/from an electrolyte or oxide material in basket 310 which plate 350 may contact. Such insulation may be achieved in several ways, including physically separating cathode plate 350 from basket 310. As shown in FIG. 3, cathode plate 350 may extend into a central portion of basket 310 without directly touching basket 310. As shown in FIG. 4, one or more insulating pads or bands 355 may be placed on cathode plate 350 for proper alignment within basket 310 while still electrically insulating cathode plate 350 and basket 310. If insulating bands 355 seat against an inner surface of upper portion 311 and/or are fabricated from a material that is also a thermal insulator, such as a ceramic material, bands 355 may additionally impede heat transfer up cathode plate 350 or into upper portion 311 of basket 310. Further, where a support 380 of cathode plate 350 rests on assembly support 340, an insulating pad or buffer 370 may be interposed between support 380 of cathode plate 350 and assembly support 340 to electrically insulate the two structures from one another.

Basket 310, including upper portion 311, sheet metal edge 315, and lower portion 312 dividers and bottom, and cathode plate 350 are fabricated from an electrically conductive material that is resilient against corrosive or thermal damage that may be caused by the operating electrolyte and will not substantially react with the material being reduced. For example, stainless steel or another nonreactive metallic alloy or material, including tungsten, molybdenum, tantalum, etc., may be used for basket 310 and cathode plate 350. Other components of example embodiment modular cathode assembly 300 may be equally conductive, with the exception of insulator 370, bands 355, and handling structures (discussed below). Materials in cathode plate 350 and basket 310 may further be fabricated and shaped to increase strength and rigidity. For example, stiffening hems or ribs 351 may be formed in cathode plate 350 or in sheet metal edge 315 to decrease the risk of bowing or other distortion and/or misalignment between cathode plate 350 and basket 310.

As shown in FIG. 3, a lift handle 381 may be connected to support 380 to permit removal, movement, or other handling of cathode plate 350 individually. For example, cathode plate 350 may be removed from cathode assembly 300 by a user through handle 381, leaving only basket 310. This may be advantageous in selectively cleaning, repairing, or replacing cathode plate 350 and/or harvesting or inserting material into/from basket 310. Lift handle 381 is electrically insulated from cathode plate 350 and support 380, so as to prevent user electrocution and other unwanted current flow through example electrolytic reducing systems.

Cathode assembly support 340 may further include a lift basket post 390 for removing/inserting or otherwise handling or moving cathode assembly 300, including basket 310 and potentially cathode plate 350. Lift basket posts 390 may be placed at either end of cathode assembly support 340 and/or be insulated from the remainder of example embodiment modular cathode assembly 300. When used in a larger reduction system, such as EORS 1000, individual modular cathode assemblies 300, and all subcomponents thereof including basket 310 and cathode plate 350, may be moved and handled, automatically or manually, at various positions through the lift basket post 390.

As shown in FIG. 3, example embodiment modular cathode assembly 300 includes one or more cathode assembly connectors 385 where modular cathode assembly 300 may mechanically and electrically connect to receive electrical power. Cathode assembly connectors 385 may be a variety of shapes and sizes, including standard plugs and/or cables, or, in example modular cathode assembly 300, knife-edge contacts that are shaped to seat into receiving fork-type connectors (FIG. 5) from example power distribution systems. Equivalent pairs of cathode assembly connectors 385 may be placed on one or both sides of modular cathode assembly 300, to provide even power to the assembly.

Cathode assembly connectors 385 may electrically connect to, and provide appropriate reducing potential to, various components within example embodiment modular cathode assembly 300. For example, two separate pairs of cathode assembly connectors, 385*a* and 385*b*, may connect to different power sources and provide different electrical power, current, voltage, polarity, etc. to different parts of assembly 300. As shown in FIG. 4, inner connectors 385*a* may connect to cathode plate 350 through support 380. Inner connectors 385*a* may extend through insulator 370 and assembly support 340 without electrical contact so as to insulate cathode plate 350 from each other component. Outer connectors 385*b* may connect directly to assembly support 340 and basket 310. In this way, different electrical currents, voltages, polarities, etc. may be provided to cathode plate 350 and basket 310 without electrical shorting between the two.

Figure 5:
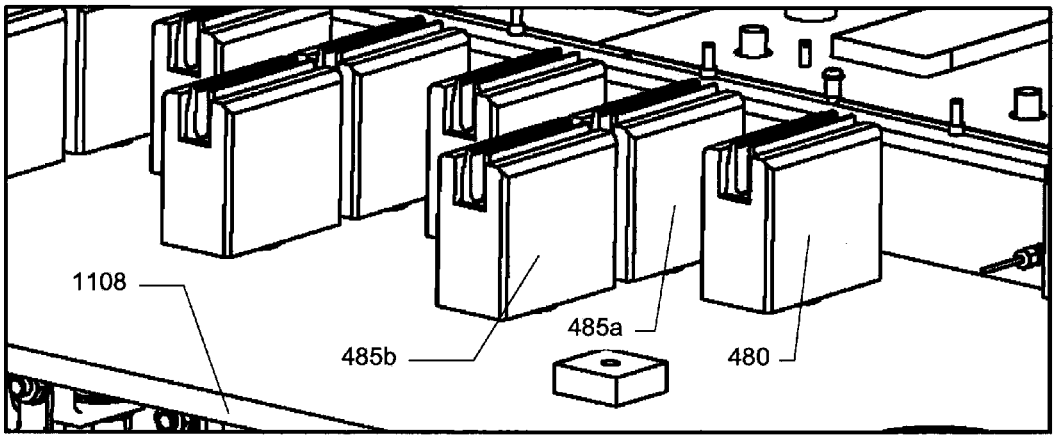
FIG. 5 is an illustration of example electrical connector configurations useable with example embodiment modular cathode assemblies.

FIG. 5 is an illustration of example cathode assembly contacts 485*a* and 485*b* that may include a fork-type conductive contacts surrounded by an insulator, capable of receiving and providing power to modular cathode assembly connectors 385*a* and 385*b*. Of course, contacts 485*a* and 485*b* may be in any configuration or structure, and modular cathode connectors 385*a* and 385*b* may provide equivalent opposite configurations for mating. Anode assembly contacts 480 are also shown near cathode assembly contact 485*a* and 485*b*. Each cathode assembly contact 485*a* and 485*b* may be seated in top plate 1108 at any position(s) desired to be available to modular cathode assemblies. Each cathode assembly contact 485*a* and 485*b* may be parallel and aligned with other contacts on an opposite side of reduction systems, so as to provide a planar, thin-profile electrical contact area for modular cathode assemblies 300 connecting thereto through connectors 385*a* and 385*b*.

Cathode assembly contacts 485*b* and 485*a* may provide different levels of electrical power, voltage, and/or current to connectors 385*b* and 385*a* and thus to basket 310 and cathode plate 350, respectively. For example, contact 485*a* may provide higher power to connectors 385*a* and cathode plate 350, near levels of opposite polarity provided through anode contacts 480. This may cause electrons to flow from cathode plate 350 into the electrolyte or material to be reduced and ultimately to anode assemblies and reduce oxides or other materials held in basket 310, in accordance with the reducing schemes discussed above.

Contact 485*b* may provide lower and/or opposite polarity secondary power to contact 385*b* and basket 310, compared to contact 485*b*. As an example, lower secondary power may be 2.3 V and 225 A, while primary level power may be 2.4 V and 950 A, or primary and secondary power levels may be of opposite polarity between cathode plate 350 and basket 310, for example. In this way, opposite and variable electrical power may be provided to example embodiment modular cathode assembly 300 contacting cathode assembly contacts 485*a* and 485*b* through connectors 385*a* and 385*b*. Additionally, both primary and secondary levels of power may be provided through contact 485*a* to connector 385*a*, or any other desired or variable level of power for operating example reduction systems. Table 1 below shows examples of power supplies for each contact and power line thereto.

TABLE 1

| Power Level (Polarity) | Connector | Contact | For Electrode |
|---|---|---|---|
| Primary (+) | Anode | 480 | Anode Assembly |
| Primary (−) or Secondary (−) | 385a | 485a | Cathode Plate (−) |
| Secondary (+) | 386b | 485b | Basket (+) |

Because basket 310 may act as a secondary anode when charged with opposite polarity from cathode plate 350, current may flow through the electrolyte or material to be reduced between cathode plate 350 and basket 310. This secondary internal current in example embodiment cathode assembly 300 may prevent metallic lithium or dissolved metallic alkali or alkaline earth atoms from exiting basket lower section 312 where it may not contact material to be reduced, such as a metal oxide feed. Operators may selectively charge basket 310 based on measured electrical characteristics of reduction systems, such as when operators determine electrolyte within basket contains dissolved metallic alkali or alkaline earth atoms.

As shown in FIG. 1, example embodiment modular cathode assemblies 300 are useable as cathode assemblies 1300 and may be standardized and used in interchangeable combination, in numbers based on reducing need. For example, if each modular cathode assembly 300 includes similarly-configured contacts 385, any modular cathode assembly 300 may be replaced with another or moved to other correspondingly-configured locations in a reducing system, such as EORS 1000. Each anode assembly may be powered and placed in a proximity, such as alternately, with a cathode assembly to provide a desired and efficient reducing action to metal oxides in the cathode assemblies. Such flexibility may permit large amounts of reduced metal to be formed in predictable, even amounts with controlled resource consumption and reduced system complexity and/or damage risk in example embodiment systems using example embodiment modular cathode assemblies 300.

Example embodiments discussed above may be used in unique reduction processes and methods in connection with example systems and anode assembly embodiments. Example methods include determining a position or configuration of one or more modular cathode assemblies within a reduction system. Such determination may be based on an amount of material to be reduced, desired operating power levels or temperatures, anode assembly positions, and/or any other set or desired operating parameter of the system. Example methods may further connect cathode assemblies to a power source. Because example assemblies are modular, external connections may be made uniform as well, and a single type of connection may work with all example embodiment cathode assemblies. An electrolyte used in reduction systems may be made molten or fluid in order to position anode and/or cathode assemblies at the determined positions in contact with the electrolyte.

A desired power level or levels, measured in current or voltage or polarity, is applied to cathode assemblies through an electrical system so as to charge baskets and/or plates therein in example methods. This charging, while the basket and plate are contacted with a metal oxide and electrolyte in contact with nearby anodes, reduces the metal oxide in the baskets or in contact with the same in the electrolyte, while de-ionizing some oxygen dissolved into the electrolyte in the cathode assembly. Example methods may further swap modular parts of assemblies or entire assemblies within reduction systems based on repair or system configuration needs, providing a flexible system than can produce variable amounts of reduced metal and/or be operated at desired power levels, electrolyte temperatures, and/or any other system parameter based on modular configuration. Following reduction, the reduced metal may be removed and used in a variety of chemical processes based on the identity of the reduced metal. For example, reduced uranium metal may be reprocessed into nuclear fuel.

Example embodiments thus being described, it will be appreciated by one skilled in the art that example embodiments may be varied through routine experimentation and without further inventive activity. For example, although baskets in cathode assemblies containing three rectangular compartments are shown, it is of course understood that other numbers and shapes of compartments and overall configurations of baskets may be used based on expected cathode assembly placement, power lever, necessary oxidizing potential, etc. Variations are not to be regarded as departure from the spirit and scope of the example embodiments, and all such modifications as would be obvious to one skilled in the art are intended to be included within the scope of the following claims.

What is claimed is:

1. An electrolytic oxide reduction system, comprising:

an electrolyte container containing an electrolyte;

at least one modular anode assembly supported above the electrolyte container and extending into the electrolyte; and at least one modular cathode assembly supported above the electrolyte container and extending into the electrolyte, the modular cathode assembly including, a cathode basket including a permeable surface permitting the electrolyte to pass through the cathode basket, the cathode basket being electrically conductive, the cathode basket being a cathode, and a cathode plate extending into the cathode basket, the cathode plate being electrically insulated from the cathode basket, the cathode plate being electrically conductive.

2. The electrolytic oxide reduction system of claim 1, wherein the cathode basket includes an upper portion and a lower portion, the upper portion and the lower portion being electrically connected and defining at least one gap in the cathode basket through which material may be placed in the cathode basket, wherein the cathode basket has a planar shape, and wherein the lower portion includes the permeable surface on at least two sides.

3. The electrolytic oxide reduction system of claim 1, wherein the modular cathode assembly further includes at least one insulating band on a surface of the cathode plate, the insulating band having a thickness and length to seat between the cathode plate and cathode basket.

4. The electrolytic oxide reduction system of claim 3, further comprising:

at least one basket contact, the modular cathode assembly further including a basket electrical connector shaped to electrically and mechanically connect to the basket contact, the basket electrical connector being electrically connected to the cathode basket; and at least one cathode plate contact, the modular cathode assembly further including a plate electrical connector shaped to electrically and mechanically connect to the cathode plate contact, the plate electrical connector being electrically connected to the cathode plate and electrically insulated from the cathode basket and the basket electrical connector.

5. The electrolytic oxide reduction system of claim 4, wherein a pair of the basket contacts and a pair of the cathode plate contacts are each separated and arranged on opposite sides of the electrolyte container and wherein the basket electrical connector and the plate electrical connector have a same knife-edge shape.

6. The electrolytic oxide reduction system of claim 1, wherein the cathode basket is electrically connected to a first cathode power source, the cathode plate is connected to a second cathode power source, and the first cathode power source is independent of the second cathode power source.

7. The electrolytic oxide reduction system of claim 6, wherein the at least one modular anode assembly is connected to an anode power source.

8. The electrolytic oxide reduction system of claim 1, wherein the cathode basket includes a first surface and an opposing second surface, the first and second surfaces being planar surfaces, the cathode plate being between the first surface and the second surface of the cathode basket.

9. The electrolytic oxide reduction system of claim 1, wherein the cathode basket is between adjacent modular anode assemblies.

* * * * *

UNITED STATES PATENT AND TRADEMARK OFFICE

CERTIFICATE OF CORRECTION

PATENT NO. : 8,900,439 B2
APPLICATION NO. : 12/978005
DATED : December 2, 2014
INVENTOR(S) : Wiedmeyer et al.

It is certified that error appears in the above-identified patent and that said Letters Patent is hereby corrected as shown below:

Title Page

(*) Notice: Delete "This patent is subject to a Terminal Disclaimer"

Signed and Sealed this
Nineteenth Day of May, 2015

Michelle K. Lee

Michelle K. Lee
*Director of the United States Patent and Trademark Office*